US006702656B1

(12) United States Patent
Hibbert

(10) Patent No.: US 6,702,656 B1
(45) Date of Patent: Mar. 9, 2004

(54) SNOW SKI AND SNOWBOARD EDGE SHARPENING DEVICE

(75) Inventor: David A. Hibbert, Chapel Hill, NC (US)

(73) Assignee: EdgeTune, Inc., Laconia, NH (US)

( * ) Notice: Subject to any disclaimer, the term of this patent is extended or adjusted under 35 U.S.C. 154(b) by 0 days.

(21) Appl. No.: 10/244,339

(22) Filed: Sep. 16, 2002

(51) Int. Cl.[7] ..... B24B 9/04

(52) U.S. Cl. ..... 451/120; 451/344; 451/360; 451/460

(58) Field of Search ..... 451/120, 344, 451/348, 349, 358, 360, 391, 460

(56) References Cited

U.S. PATENT DOCUMENTS

| | | | | | |
|---|---|---|---|---|---|
| 3,893,372 | A | * | 7/1975 | Strakeljahn | 409/180 |
| 4,406,568 | A | * | 9/1983 | Rogers et al. | 409/182 |
| 4,442,636 | A | | 4/1984 | Obland | 51/205 |
| 4,630,409 | A | | 12/1986 | Hofstetter | 51/361 |
| 4,679,356 | A | | 7/1987 | Thomas | 51/205 |
| 4,721,020 | A | | 1/1988 | Stumpf | 76/83 |
| 4,966,055 | A | | 10/1990 | Staggs | 76/80.5 |
| 5,136,816 | A | * | 8/1992 | Beckingham | 451/282 |
| 5,772,368 | A | * | 6/1998 | Posh | 409/182 |
| 6,379,234 | B1 | | 4/2002 | MacKay | 451/359 |

FOREIGN PATENT DOCUMENTS

| | | | | |
|---|---|---|---|---|
| CH | 661876 A5 | * | 8/1987 | A63C/11/06 |
| DE | 3113492 A1 | * | 10/1982 | B24B/9/04 |
| DE | 4413935 A1 | * | 10/1995 | B24B/9/04 |
| EP | 58983 A1 | * | 9/1982 | A63C/11/06 |

* cited by examiner

*Primary Examiner*—Joseph J. Hail, III
*Assistant Examiner*—David B. Thomas
(74) *Attorney, Agent, or Firm*—Olive & Olive, P.A.

(57) ABSTRACT

A device for sharpening ski edges and the like which is useful in sharpening both the side and bottom edges of skis is disclosed. The device is operable easily by an individual, is portable and allows a bevel to be sharpened into the edge where desired quickly and easily.

10 Claims, 3 Drawing Sheets

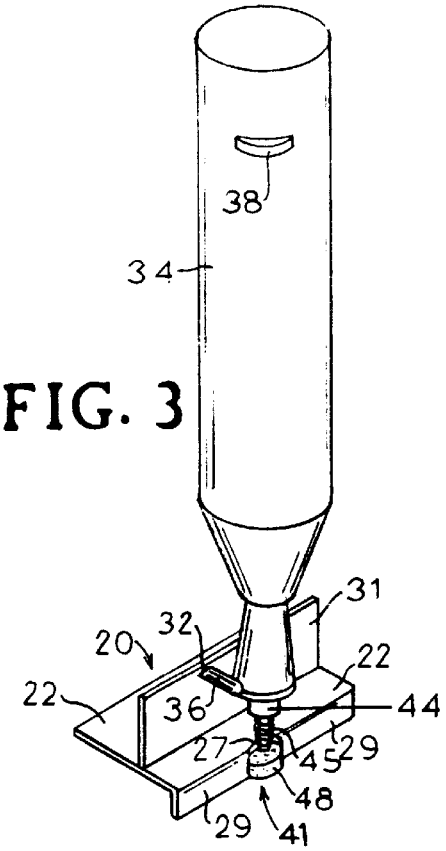
FIG. 3
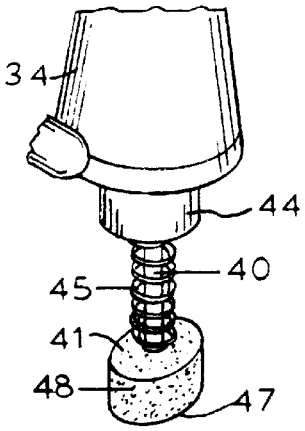
FIG. 4
FIG. 7
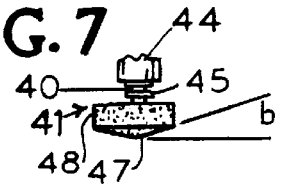
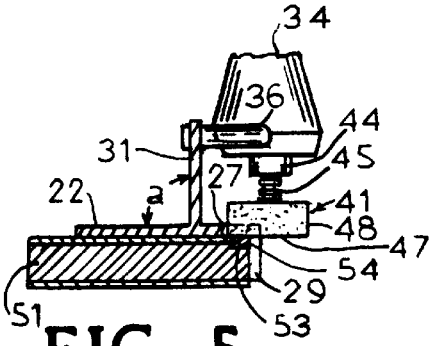
FIG. 5
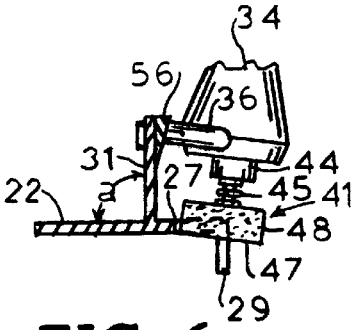
FIG. 6

SNOW SKI AND SNOWBOARD EDGE SHARPENING DEVICE

BACKGROUND OF THE INVENTION

1. Field of the Invention

The present invention relates generally to a device for sharpening snow ski edges and more specifically to a motorized device for sharpening both the bottom and side edges of a snow ski or snowboard.

2. Description of the Prior Art

Down hill snow skis, including their cousin the snowboard, are made from a wide variety of materials including wood, fiberglass, plastic, resins and the like. Today's ski bases are usually made from a hard resin plastic such as p-tex. All these skis have metal edges which run the length of both lower edges of the ski that are designed to aid in griping the snow and aid in turning. In order for the ski edge's top performance characteristics to be maintained, both the side and bottom of the metal edge must be sharpened. Beveling of the metal edges is also done while sharpening. By beveling the edges, changes in the drag and turning characteristics can be greatly affected. The base bevel on modem skis can run from about zero to two degrees while the bevel on the side edge can run from about zero to five degrees.

Ski shops have typically been considered the best place to take skis for sharpening the ski edges. These shops can afford large motorized sharpening machines that hold the skis firmly in place and quickly and accurately sharpen the whole ski. But the time and cost of taking ones skis to a ski shop keeps most people from doing such sharpening as often as it should be done for optimum performance.

Accordingly, a wide variety of devices have been developed for sharpening ski edges away from the ski shop. They basically fall into two categories, manual sharpeners and motorized sharpeners.

Manual sharpeners tend to be a file with a file holder to maintain file alignment. There are serious problems however with the manual devices of the art. Specifically, these units are hard to keep aligned, removal of metal is uneven and because of the size of the file teeth, the file needs in general, to straddle both sides of the skis leading to problems with the p-tex base and interfering with even filing of the bottom edge. Because these manual sharpeners are extremely hard to use, people tend to discontinue their use rather rapidly. Another problem with manual sharpeners is the inability to adjust the angle on the file leaving the user with right angles (a zero degree bevel) as the only choice or at the very least the single choice of angles.

The majority of motorized sharpeners are the large floor or bench type models designed primarily for ski shop use. While there is at least one small hand held unit disclosed in the art, it suffers from difficulties in keeping the sanding disc at a proper angle since the motor, motor shaft and sanding disc are held parallel to the ski edge during use. The weight of the motor that is not supported in this configuration makes balance of the system impossible (French Patent 2,516,004). A further problem with this design is the tendency for the sanding disc to "run-away" from the user if not held tightly.

Another problem with previous motorized, hand held ski sharpeners is the lack of teaching of how one would sharpen the side edges of the skis since only bottom edge sharpening are taught.

Accordingly, it is an object of the present invention to provide a novel hand held motorized ski sharpening device that overcomes the problems discussed above.

It is also an object of the invention to provide a ski edge sharpening device that is capable of sharpening skis at a desired bevel angle.

It is yet another object to provide a ski sharpening device that is capable of sharpening both the side and bottom edges of a ski.

It is a further object to provide a sharpening device for skis that is balanced to use, does not require frequent changes of abrasives, and does not encourage the abrasive to "run-away" during use.

SUMMARY OF THE INVENTION

The present invention relates to hand held motorized devices designed to grind and sharpen the side and bottom edges of snow skis, including snowboards, at a desired bevel angle.

The device of the present invention uses a solid columnar grinding stone having a flat bottom portion to grind the bottom ski edge and a circumferential edge of the grinding stone to grind the side edge of the ski as the grinding wheel is moved along the length of the ski. The flat bottom portion can be angled as desired to give the desired bevel to the bottom edge. This grinding stone is driven by a hand held high-speed motor comprising a counter clockwise rotary driven shaft and wherein the grinding stone is spring-loaded for mounting in the drive shaft collet.

The motor is mounted to an edge guide holding the grinding stone against either the bottom edge or side edge as desired and consists of a base to lay flat on the ski, a runner portion to guide the base along the ski edge and a grinding stone aperture for allowing room for the grinding stone to be positioned against the bottom or side ski edge.

In one embodiment, the motor is mounted at an angle such that the desired bevel angle is shaped into the ski bottom edge while using a flat bottom grinding stone.

The edge guide is moved along the length of the ski with the grinding stone either against the bottom or side edge of the ski until the desired beveling and sharpening is obtained.

BRIEF DESCRIPTION OF THE DRAWINGS

FIG. 3 is a perspective view of the motor and grinding wheel mounted on the edge guide.

FIG. 4 is a pictorial view showing the columnar grinding wheel and collet spring mounted in the motor collet via a mounting axle.

FIG. 5 is a side view of the device of the invention mounted on a ski for sharpening the bottom edge.

FIG. 6 is a side view of an embodiment of the edge guide that allows for adjustable bevel edges.

FIG. 7 is a side view of the device of the invention mounted on a ski for sharpening the bottom edge.

DETAILED DESCRIPTION OF THE INVENTION

Figure 1:
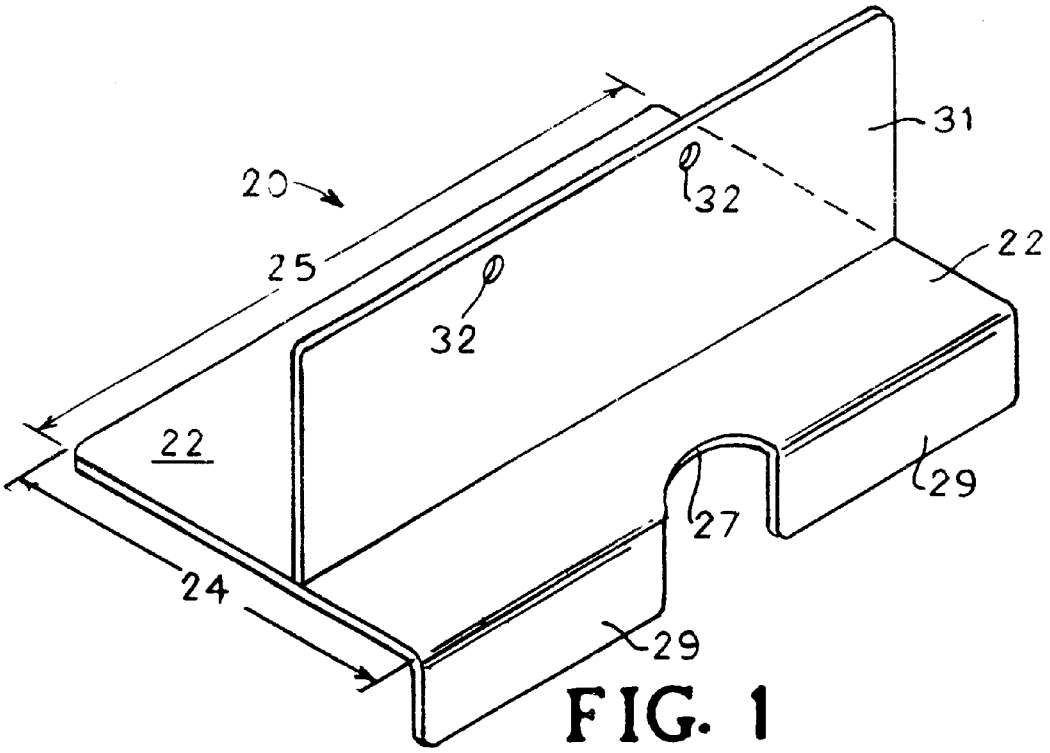
FIG. 1 is a perspective view of the sharpening edge guide of the present invention.

Now referring to the drawings in greater detail, a motorized ski sharpening device is presented for sharpening the bottom and side edges of a ski or the like. FIG. 1 is a perspective view of an edge guide 20 utilized by the sharpening device of the invention having a flat portion 22. Its width 24 is designed to be at least about half the width of a ski or at least wide enough to form a stable platform against a ski base when in position. In one embodiment, width 24 of flat portion 22 is about two to three inches. The length 25 is sufficient to stably run the length of the ski and provides aperture 27 for accommodating the grinding stone 41 (shown in FIG. 3). Also, runner portion 29 is formed at about ninety degrees to flat portion 22 and runs along the length of a ski edge to be sharpened.

Motor mount 31 is designed as a means to hold a motor at a desired position or at a desired angle for beveling. In this embodiment, motor mounting holes 32 are designed to receive a pair of mounting bolts from a hand held motor 34.

Figure 2:
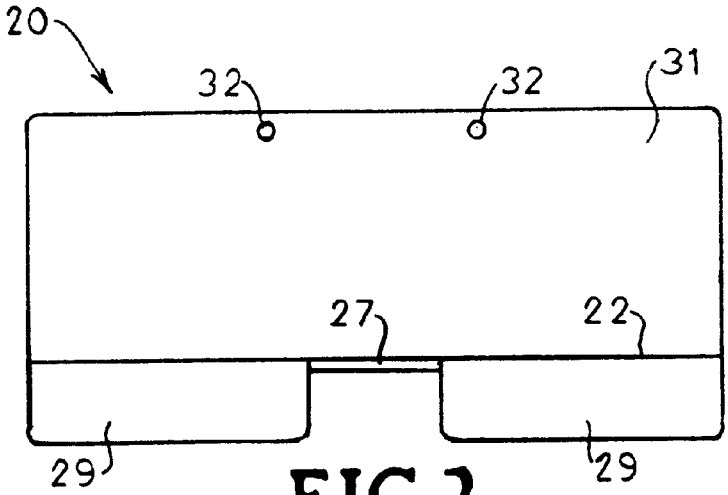
FIG. 2 is a front elevation view of the sharpening edge guide.

FIG. 2 is a front elevation view of edge guide 20 showing flat portion 22 and motor mounting plate 31. In this view, the runner portion 29 on both sides of grinding stone aperture 27 is clearly seen. Motor mounting holes 32 are also clearly seen.

FIG. 3 is again a perspective view of edge guide 20. This time motor 34 is shown mounted to motor mounting plate 31 via bolts 36 (only one of which is seen) into motor mounting holes 32. Shown on motor 34 is variable speed switch 38 for adjusting the speed of spindle 40 to a desired speed. In one embodiment, motor 34 can drive the spindle apparatus from zero to about 25,000 to 35,000 RPM however more or less rotation is acceptable, as desired. At the end of spindle 40 is the solid columnar grinding stone 41. In one embodiment, stone 41 is an aluminum oxide grinding stone. Other embodiments are contemplated but in all cases must be a solid grinding material, either artificial or natural, for grinding as opposed to, for example, a grinding stone sandpaper on a mounting wheel that has grinding material on the surface of the circumference only such as in French Patent 2,516,064.

FIG. 4 is a pictorial view of the solid columnar grinding stone 41. From this perspective, spindle 40 can be seen mounted in collet 44. Collet 44 is internally threaded to tighten around spindle 40. In one embodiment, spindle 40 is threaded opposite to the direction of spin of motor 34. For example, where motor 34 rotates spindle 40 in a counter clockwise direction as viewed from the end of collet 44, collet 44 would have a right hand thread. The advantage of this arrangement will be explained later. Also shown in this view is compression spring 45 is mounted on spindle 40. Spring 45 allows a height adjustment of solid columnar grinding stone 41 when spindle 40 is not completely tightened in collet 44. After proper desired height is reached, collet 44 can be tightened in any manner desired. In this embodiment, the surface of grinding stone bottom 47 is flat and is used in the device of the invention to shape and grind the bottom edge of a ski. In this embodiment, the surface is flat but in other embodiments where a bevel is needed on the bottom edge, other shapes are contemplated for the bottom 47. Also seen is the circumferential edge 48 of columnar grinding stone 41. The circumferential edge 48 is used to grind and sharpen a ski side edge when edge guide 20 is properly placed on a ski.

FIG. 5 is a side view showing a cross section of the edge guide 20 with the motor 34 and grinding stone 41 attached. The device is resting in this view on a ski bottom edge 53 shown also in cross section. Ski 51 has a bottom edge 53 and side edge 54 as depicted. Motor mounting plate 31 is shown as an upright with flat portion 22 shown horizontally resting on ski 51. Angle "a" is shown in this embodiment as ninety degrees. When spindle 40 is mounted parallel to motor mounting plate 31 and bottom surface 47 perpendicular to the spindle 40 grinding stone 41 will put a zero degree bevel on the bottom edge 53 of ski 51. Adjusting of angle "a" will create a different bevel angle on bottom edge 53 as desired. Normally this is between about zero degrees and five degrees bevel angle.

FIG. 6 depicts a view of an alternate embodiment of the mounting plate 31 arrangement. In the previous FIG. 5, the motor mounting angle of the mounting plate 31 is fixed at angle "a" meaning that the bevel angle is predetermined and fixed. While the angle "a" can be made to different angles, once made, the angle "a" of the edge guide 20 will not change. In the embodiment depicted in FIG. 6, angle wedge 56 is placed between motor 34 and motor mounting plate 31. Wedge 56 can be fixed but in one embodiment can be removable and interchanged with wedges of different angles thus allowing for changing of the final bevel angle on the bottom edge 53 of a ski.

FIG. 7 is a side view of another embodiment of the invention for adjusting the bevel angle of ski bottom edge 53. In this view, the grinding stone bottom 47 has a bevel angle "b". This angle is imparted to the ski edge 53 as a bevel when the grinding stone 41 is mounted as previously described in FIG. 5.

Figure 8:
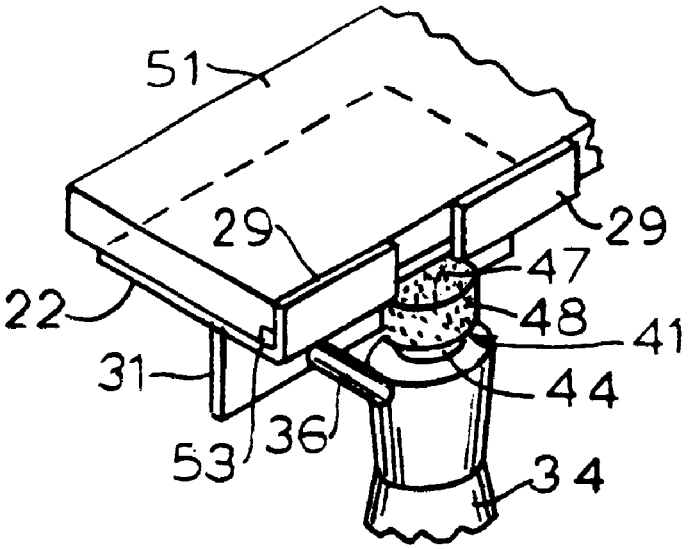
FIG. 8 is a perspective view of the device of the invention mounted on a ski for sharpening the bottom edge.

FIG. 8 is a perspective view of the device of the invention in use on a ski, sharpening the bottom edge 53 of a ski 51. In use, motor 34 is mounted to edge guide 20. Spindle 40 of grinding stone 41 is placed loosely in collet 44. Edge guide 20 is then placed on a ski bottom aligned with the runner portion tight against side edge with the bottom of grinding stone 41 flat against bottom edge 53. The user then pushes grinding stone spindle up further into collet 44. Motor 34 is started at about 25,000 to 35,000 RPM and edge guide 20 is moved up back and forth on the edge of ski 51. In one embodiment, this loose spindle will be tightened at the proper height due to the counter clockwise rotating of motor collet 44 and the right hand tightening nut of collet 44. The device is run back and forth on the ski edge until the desired level of sharpness or bevel is achieved.

Figure 9:
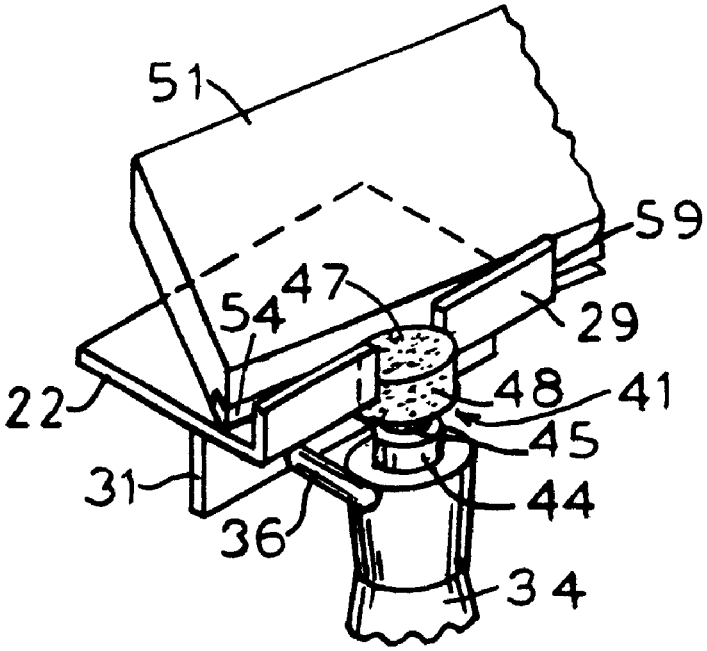
FIG. 9 is a perspective view of the device of the invention mounted on a ski for sharpening the side edge.

FIG. 9 is a perspective view of the device of the invention in use on a ski, sharpening a side edge 54 of ski 51. In order to use the device, motor 34 is mounted on edge guide 20 as above. Spindle 40 is tightened in collet 44 at a height such that grinding stone circumferential edge 48 rests against ski 51 side edge 54 when edge guide 20 is positioned as shown. The flat portion 22 is again against the ski bottom. In this embodiment, the circumferential edge 48 is against ski side edge 54, which means that runner portion 29 does not fit flat against the ski side edge 54. Instead, runner edge corner 59 and circumferential edge 48 is held against ski side edge 54 and moved back and forth on the ski side edge 54 until the desired level of sharpness is achieved.

It is clear that substitution of grinding stones, spindles, motors, desired angles and the like are well within the skill in the art in view of the disclosure herein. Nothing in the embodiments or drawings herein is designed to be limiting.

What is claimed is:

1. A device for sharpening the side and bottom edges of snow skis and the like comprising:

(a) a handheld high-speed motor comprising a drive shaft having an attachment collet affixed to a distal end of the drive shaft capable of holding a spindle in a fixed or movable position;

(b) a solid columnar grinding stone comprising a bottom grinding portion, a circumferential edge grinding portion and a collet mounting spindle, the collet mounting spindle capable of being mounted in the attachment collet such that the grinding stone is capable of travel a desired distance in a direction distal and proximal direction to the collet or in a fixed position; and (c) an edge guide comprising:

(i) a base having a plurality of edges designed to be positioned essentially flat on a bottom of the ski;

(ii) a runner portion positioned along an edge of the base designed to be positioned along the ski side edge;

(iii) a grinding stone aperture; and (iv) a motor mounting means designed to hold the motor such that the bottom grinding portion of the grinding wheel is positioned in the grinding stone aperture at a desired angle relative to the bottom of the ski and wherein the bottom grinding portion is pushed back from its most distal position when the bottom grinding portion is positioned on the bottom edge to be sharpened and in a more distal position when the circumferential edge is positioned next to the ski side edge to be sharpened.

2. A device for sharpening the side and bottom edges of snow skis and the like according to claim 1 wherein the grinding stone is an aluminum oxide grinding composition.

3. A device for sharpening the side and bottom edges of snow skis and the like according to claim 1 wherein the motor is capable of running at from about 25,000 to 35,000 RPM's.

4. A device for sharpening the side and bottom edges of snow skis and the like according to claim 1 wherein the motor mounting means holds the motor at a fixed angle.

5. A device for sharpening the side and bottom edges of snow skis and the like according to claim 1 wherein the motor mounting means holds the motor at a variable angle.

6. A device for sharpening the side and bottom edges of snow skis and the like according to claim 1 wherein the drive shaft rotates counter clockwise and the attachment collet has a tightening nut that tightens to the right.

7. A device for sharpening the side and bottom edges of snow skis and the like according to claim 1 wherein the grinding stone has a flat bottom and square sides.

8. A device for sharpening the side and bottom edges of snow skis and the like according to claim 1 wherein the desired angle is from about zero to five degrees.

9. A device for sharpening the side and bottom edges of snow skis and the like according to claim 1 wherein the grinding stone has an angled bottom or side corresponding to a desired bevel angle to be sharpened on the ski edge.

10. A device for sharpening the side and bottom edges of snow skis and the like according to claim 1 wherein the collet mounting spindle comprises a collet mounting spindle spring capable of holding the grinding stone in its most distal position.

* * * * *